US011421394B2

(12) United States Patent
Jo

(10) Patent No.: US 11,421,394 B2
(45) Date of Patent: Aug. 23, 2022

(54) DOUBLE SAFETY DEVICE FOR QUICK COUPLER

(71) Applicant: DAEMO ENGINEERING CO., LTD., Siheung-si (KR)

(72) Inventor: Young Hum Jo, Ulsan (KR)

( * ) Notice: Subject to any disclaimer, the term of this patent is extended or adjusted under 35 U.S.C. 154(b) by 680 days.

(21) Appl. No.: 16/326,050

(22) PCT Filed: Aug. 18, 2016

(86) PCT No.: PCT/KR2016/009084

§ 371 (c)(1),
(2) Date: Feb. 15, 2019

(87) PCT Pub. No.: WO2018/034362

PCT Pub. Date: Feb. 22, 2018

(65) Prior Publication Data

US 2019/0177946 A1 Jun. 13, 2019

(51) Int. Cl.
*E02F 3/36* (2006.01)
*E02F 9/24* (2006.01)

(52) U.S. Cl.
CPC ..... *E02F 3/36* (2013.01); *E02F 3/3618* (2013.01); *E02F 3/3622* (2013.01); *E02F 9/24* (2013.01)

(58) Field of Classification Search
CPC ..... E02F 3/3618; E02F 3/3622; E02F 3/3663; E02F 9/2267; E02F 9/2271; E02F 3/364;
(Continued)

(56) References Cited

U.S. PATENT DOCUMENTS 5,456,030 A * 10/1995 Barone ..... E02F 3/3622 37/468
6,379,075 B1 4/2002 Shamblin et al.
(Continued)

FOREIGN PATENT DOCUMENTS

CN 102667005 A 9/2012
EP 0521560 A2 1/1993
(Continued)

*Primary Examiner* — Edwin J Toledo-Duran
(74) *Attorney, Agent, or Firm* — Rabin & Berdo, P.C.

(57) ABSTRACT

The present invention relates to a double safety device for a quick coupler, which, in a coupling process of a quick coupler for connecting a heavy equipment attachment and an excavator, automatically prevents unintentional separation between an attachment pin and a fixed hook, and enables a locking device to be automatically operated in association with a cylinder operation for slidably moving a hitch and elastic force of first and second compression springs. The double safety device for a quick coupler according to the present invention comprises: a quick coupler body mounted to an end of an excavator arm and a push link; a fixed hook disposed on one side of the quick coupler body and coupled to a first attachment pin; a hitch disposed on the other side of the quick coupler body and engaged with or disengaged from a second attachment pin according to an operation of a hydraulic cylinder; and a locking means which is operated in association with a cylinder operation for operating the hitch, and prevents unintentional release of a coupling state between the fixed hook and the first attachment pin by compressive elastic force of first and second compression springs.

6 Claims, 10 Drawing Sheets

(58) Field of Classification Search
CPC ..... E02F 3/3627; E02F 3/3645; E02F 3/36; E02F 9/24; E02F 3/365; F15B 13/0405; F16K 15/04
USPC ..... 403/322.1, 322.3, 322.4, 321, 324, 327, 403/330; 37/468; 172/272, 273, 274, 172/275; 414/705, 723
See application file for complete search history.

(56) References Cited

U.S. PATENT DOCUMENTS 6,691,438 B2 * 2/2004 Fatemi ..... E02F 3/3627 37/468
6,881,002 B2 4/2005 Fatemi
6,964,122 B2 * 11/2005 Cunningham ..... E02F 3/3663 37/468
7,426,796 B2 * 9/2008 Cunningham ..... E02F 3/3618 37/234
8,662,817 B2 * 3/2014 Daraie ..... E02F 3/3618 37/468
8,678,697 B2 * 3/2014 Monaghan ..... E02F 3/3663 37/468
8,684,623 B2 * 4/2014 Robl ..... E02F 3/365 403/322.3
2002/0157287 A1 * 10/2002 Mieger ..... E02F 3/3654 37/468
2002/0176772 A1 * 11/2002 Hung ..... E02F 3/365 414/723
2005/0169703 A1 * 8/2005 Fatemi ..... E02F 3/3663 403/321
2006/0037220 A1 2/2006 Cunningham et al.
2007/0166143 A1 * 7/2007 Hart ..... E02F 3/3663 414/723
2010/0192425 A1 * 8/2010 Miller ..... E02F 3/3618 37/468
2010/0232920 A1 * 9/2010 Calvert ..... E02F 3/3663 414/723
2011/0091267 A1 * 4/2011 Hill ..... E02F 3/365 91/462
2011/0243654 A1 * 10/2011 Hill ..... E02F 3/3663 403/324
2012/0093572 A1 * 4/2012 Lim ..... E02F 3/365 403/31
2012/0177472 A1 7/2012 Hill
2013/0164080 A1 * 6/2013 Miller ..... E02F 3/3672 403/373
2016/0201290 A1 * 7/2016 O'Connor ..... E02F 3/3622 403/376
2016/0281319 A1 * 9/2016 Park ..... E02F 3/365

FOREIGN PATENT DOCUMENTS

EP 3040482 A1 7/2016
GB 2492850 A 1/2013
KR 10-0739341 B1 7/2007
KR 10-2011-0005057 A 1/2011
KR 10-1210833 B1 12/2012
WO 2015030282 A1 3/2015

* cited by examiner

DOUBLE SAFETY DEVICE FOR QUICK COUPLER

TECHNICAL FIELD

The present invention relates to a double safety device for a quick coupler, and more specifically, to a double safety device for a quick coupler which prevents unintentional separation between an attachment pin and a quick coupler body in a coupling process of the quick coupler for connecting a heavy equipment attachment with an excavator, improves a coupling property of a hitch and the attachment pin by slidably moving the hitch in a lateral direction, and has an improved structure to allow a locking means to be automatically operated in association with elastic force of first and second compression springs and operation of the cylinder and prevent unintentional release from the attachment equipment in an emergency situation in which a hydraulic pressure is not transmitted to the cylinder by elastic force of the first and second compression springs.

BACKGROUND ART

Generally, heavy equipment such as an excavator, which is used in a construction field or a civil engineering construction field, is widely used in road construction, water and sewage system construction, building foundation construction, ground shaping construction, construction of collecting earth and sand, and the like, and is selectively mounted with various attachments according to operations and performs the operations.

For example, various operations may be performed by replacing various types of attachments according to operations such as an excavating operation using a bucket, operations of breaking concrete using a crusher and cutting a reinforcing bar, an operation for breaking rock and concrete using a breaker, an operation of transferring scrap metal and rock using a grab, an operation of constructing pit and water and sewage foundations using a clamshell bucket, and the like.

Generally, the attachment is coupled to an arm of the excavator in an attachable or detachable structure to be replaced according to operations, and a quick coupler, which easily connects an attachment using a separate coupler mounted on the excavator arm, has been recently developed and widely used.

The quick coupler is firmly mounted on an excavator arm and a push link of a cylinder through two pin coupling structures of the quick coupler body and has a structure in which an attachment is coupled by a fixed hook and a hitch.

Therefore, an attachment can be easily handled and used through a method in which a quick coupler mounted on a front end of the arm is coupled to or separated from a bucket or a breaker by allowing an operator of the excavator to operate a lever.

Meanwhile, the quick coupler includes a safety device as a device for preventing a problem in which an attachment is separated by a malfunction of a hydraulic cylinder of the quick coupler or damage to a hydraulic hose during operation, e.g., a safety pin, so as to prepare for an accident.

However, when the attachment, such as a bucket, a breaker, or the like, is replaced, an operator should manually separate a safe pin from the mounted attachment or, after a new attachment is mounted, couple the safe pin to the new attachment, and thus the operation is difficult and inconvenient, and a great deal of time for operations is consumed.

In the prior art, Korean Registration Patent No. 10-0739341, "Attachment Coupler for Heavy Equipment with Automatic Safety Device" (published on: Jul. 9, 2007), a moving hook is doubly supported by a hydraulic cylinder and an automatic safety device cylinder, and an automatic safety device cylinder is in a unfastened state only when the hydraulic cylinder is normally unfastened, but an automatic safety device cylinder should be separately provided.

In another prior art, Korean Registration Patent No. 10-1210833 "Automatic Safety Device of Quick Coupler" (published on: Dec. 5, 2012), a hitch on an upper portion of the fixed hook is interworked with an operation of a sliding-type hitch to prevent separation of a pin, but a safety device has a unsolved problem of poor reliability such as problems caused by a malfunction of the hydraulic cylinder or a damage to a hydraulic hose.

In the case of the conventional quick coupler, since the hitch is rotated about a hinge to be coupled to an attachment pin, the quick coupler has a limitation due to an ambient environment when the hitch is coupled to or separated from the attachment pin.

Further, a structure of the safety device, which prevents a coupling state with the attachment pin coupled to the fixed hook from being arbitrarily released, is complicated, and the component is not easily maintained.

Technical Problem

The present invention is directed to providing a double safety device for a quick coupler which allows a structure of a locking device for safely maintaining a coupling state of an attachment pin and a quick coupler-fixed hook to be simplified and has an improved structure to allow a fixed hook to be conveniently locked and coupled by a cylinder operation for operating a hitch and an operation by compression elastic force of first and second compression springs after the fixed hook and the attachment pin for heavy equipment are assembled.

Technical Solution

In order to achieve the above-described purpose, the present invention provides a double safety device for a quick coupler, the device comprising: a quick coupler body being connected to an arm of an excavator; a fixed hook being provided on one side of the quick coupler body and being coupled with a first attachment pin; a hitch being provided on other side of the quick coupler body, being connected to a cylinder load of a cylinder and being coupled with a second attachment pin during forward motion of the cylinder load; and a locking means for preventing an arbitrary release of coupled state of the fixed hook and the first attachment pin; wherein the locking means comprises: a fastening block being positioned outside a cylinder tube of the cylinder and being fixed on the quick coupler body, a first compression spring being provided on between the fasting block and the hitch and assigning an elastic compression force, a second compression spring having an elastic compression force to push the cylinder tube toward a body stanchion and having one end supported on other side of the fastening block and other end supported on the cylinder tube, a blocking block being coupled with one side of the cylinder tube, being interlocked when the cylinder tube moves and being positioned on upper side of the fastening block to block a detachment of the fixed hook and the first attachment pin and a stopper member being formed to protrude at one side or the other side of the fastening block, and limiting a backward motion of the hitch or the blocking block by contacting during the backward motion of the hitch or the blocking block.

The locking means further comprises: a guide groove portion being formed on both outer sides of the hitch in a groove shape and a guide projection being formed to protrude from inner side surfaces of the quick coupler body facing each other and being slid inserted in the guide groove portion.

The present invention comprises: an elastic force of the first compression spring is greater than an elastic force of the second compression spring or an elastic force of the second compression spring is greater than an elastic force of the first compression spring.

The fixed hook is being formed that a locking protuberance protrudes in a direction to reduce width of entry which is entered by the first attachment pin at an end of the entry.

The blocking block comprises: a connection block being fixed to one side of the cylinder tube and being interlocked with motion of the cylinder tube and an anti-breakaway plate for preventing the first attachment pin from being broken away from the fixed hook, being coupled detachably to lower side of the connection block and being positioned on upper side of the first attachment pin when the connection block moves forward.

Advantageous Effects

According to the present invention, when a cylinder rod moves forward and backward, a hitch slidably moves forward and backward along an inner surface of a quick coupler body, and a cylinder tube is moved by forward and backward repulsive force generated when the hitch moves forward and backward in left and right directions of the cylinder tube. A blocking block connected to an end portion of the cylinder tube is interworked with the movement of the cylinder tube and selectively prevents a first attachment pin coupled to a fixed hook from being separated so as to prevent the first attachment pin coupled to the fixed hook from being separated, and thus an accident can be prevented. A coupling state of the first attachment pin assembled to the fixed hook is firmly maintained, and thus safety can be improved.

Further, the hitch is slidably moved in the quick coupler body by operation of a rod of the cylinder, and thus the hitch and a second attachment pin are conveniently coupled to or separated from each other.

Even in an emergency situation in which a hydraulic pressure is not transmitted to the cylinder due to oil leakage, an elastic force of a first compression spring pushes the hitch outward to prevent the second attachment pin and the hitch from being separated, and an elastic force of a second compression spring pushes the cylinder tube and the blocking block toward a body stanchion so that an anti-breakaway plate is positioned above the first attachment pin. Thus, a separation direction of the first attachment pin is limited to a diagonal direction based on structural properties of the fixed hook having a locking protuberance, and the anti-breakaway plate interferes with the first attachment pin to prevent the first attachment pin from being separated, and thus a function of the double safety device can be performed.

BEST MODE

Figure 1:
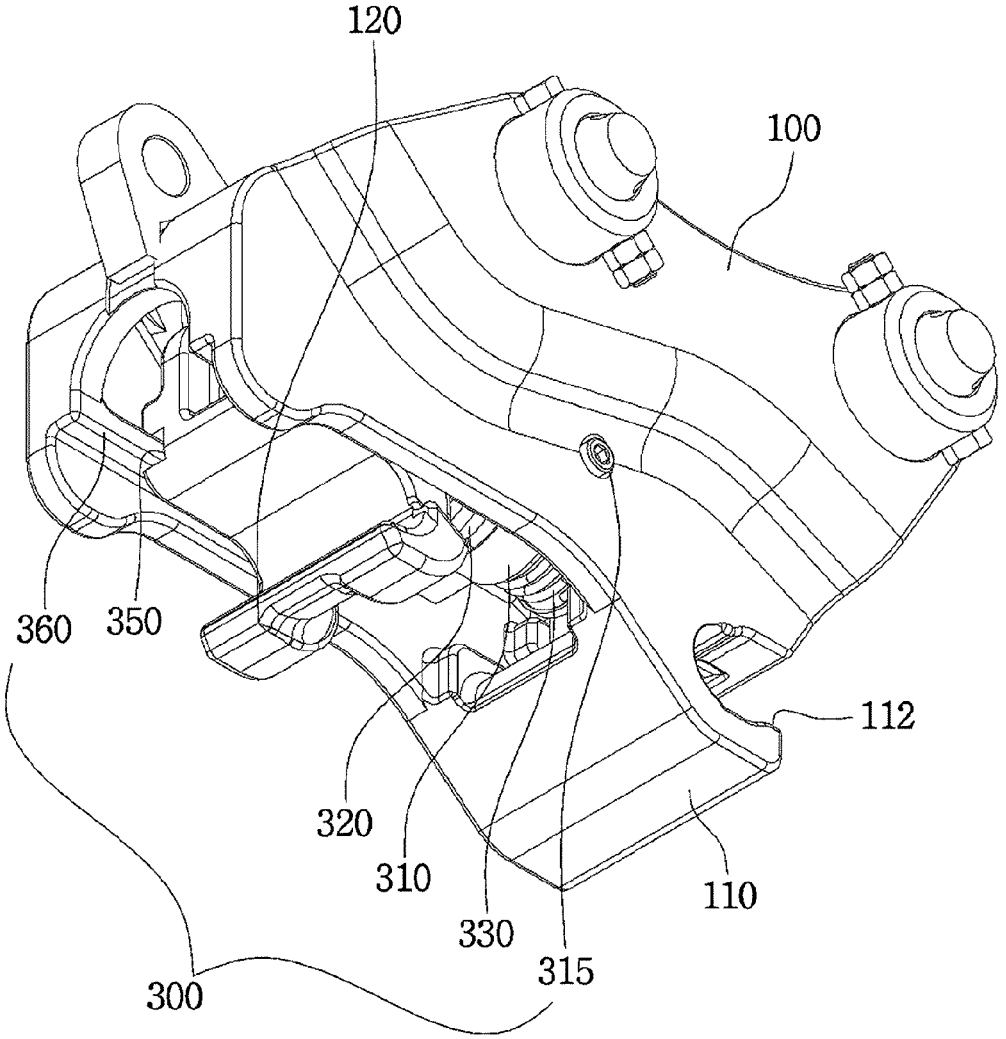
FIG. 1 is a bottom perspective view showing a double safety device of a quick coupler according to an embodiment of a present invention.

The present invention relates to a double safety device for a quick coupler which includes a quick coupler body mounted to an end portion of an excavator arm and a push link, a fixed hook disposed on one side of the quick coupler body and coupled to a first attachment pin, a hitch disposed on the other side of the quick coupler body and coupled with or separated from a second attachment pin according to operation of a hydraulic cylinder, and a locking means which is interworked with a cylinder operation for operating the hitch and prevents unintentional release of a coupling state between the fixed hook and the first attachment pin by a compressive elastic force of the first and second compression springs.

MODE FOR INVENTION

The double safety device for a quick coupler, which, in a coupling process of a quick coupler for connecting a heavy equipment attachment and an excavator, automatically prevents unintentional separation between an attachment pin and a fixed hook and enables a locking device to be automatically operated in association with a cylinder operation for slidably moving a hitch and an elastic force of first and second compression springs.

Referring to FIGS. 1 to 6, a double safety device according to an embodiment of the present invention includes a quick coupler body 100 mounted on an end portion of an excavator arm and a push link, a fixed hook 110 provided on one side of the quick coupler body 100 and coupled to a first attachment pin 21, a hitch 120 provided on the other side of the quick coupler body 100 and coupled to or separated from a second attachment pin 22 according to operation of a hydraulic cylinder 200, and a locking means 300 which is operated in association with the cylinder 200 operating the hitch 120 and prevents a coupling state of the fixed hook 110 and the first attachment pin 21 from being arbitrarily released by an elastic compression force of the first and second compression springs 320 and 330.

More specifically, the quick coupler body 100 has a structure in which both plates symmetrical to and separated from each other are connected through a connection rod 110.

Figure 2:
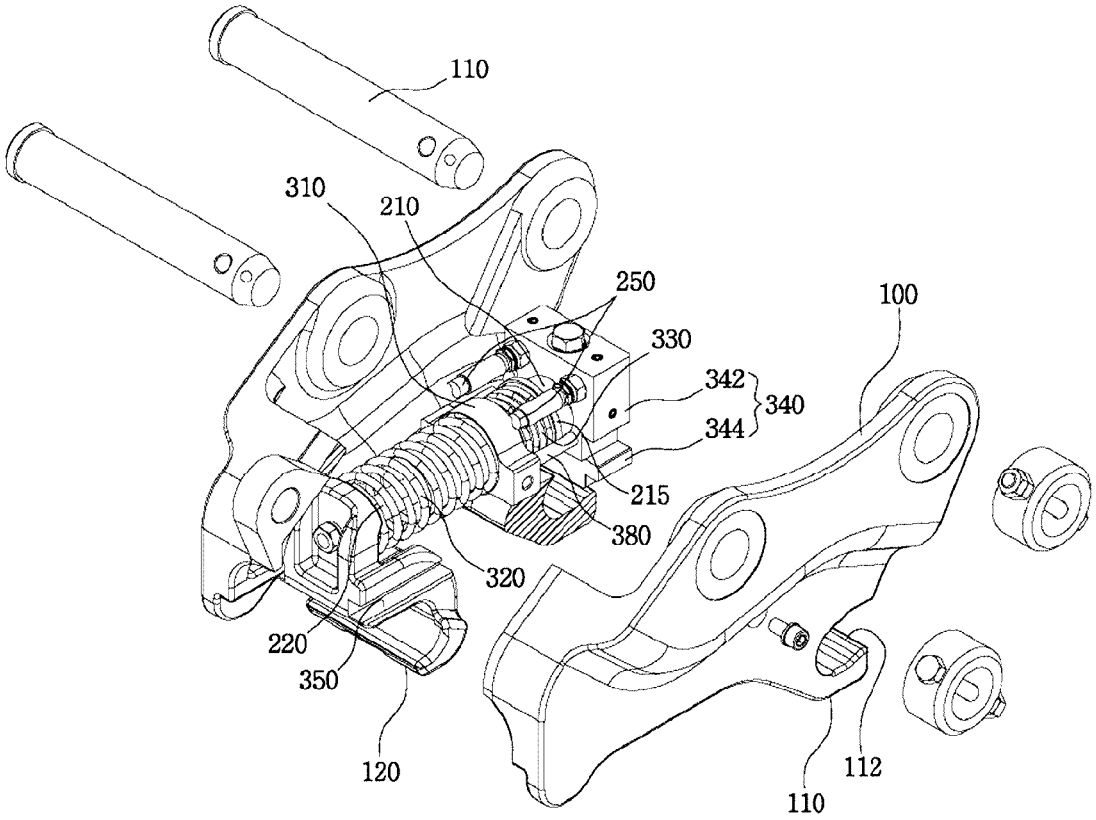
FIG. 2 is an exploded perspective view of a locking means and a quick coupler body according to the embodiment of the present invention.

As shown in FIGS. 1 and 2, the locking means 300 includes a fastening block 310 disposed outside the cylinder tube 210 of the cylinder 200 and fixed to the quick coupler body 100, a first compression spring 320 which has one end portion supported on the hitch 120 and the other end portion supported on the fastening block 310 and provides an elastic compression force toward the hitch 120, a second compression spring 330 which has one end portion supported on the other side of the fastening block 310 and the other end portion supported on a protruding part 215 protruding from an outer side of the cylinder tube 210 and provides an elastic compression force pushing the cylinder tube 210 toward the body stanchion 150, a blocking block 340 which is coupled to one side of the cylinder tube 210 and is disposed above the fixed hook 110 in association with movement of the cylinder tube 210 to block the fixed hook 110 and the first attachment pin 21 from being separated, and a stopper member 380 protruding from the other side of the fastening block 310 and stopping the blocking block 340 from moving backward.

The fastening block 310 is fixed to an outer side of the middle portion of the quick coupler body 100 by a coupling member, such as a bolt and the like, and has a structure in which the first compression spring 320 is supported on one side thereof and one end portion of the second compression spring 330 is supported on the other side thereof.

Figure 3:
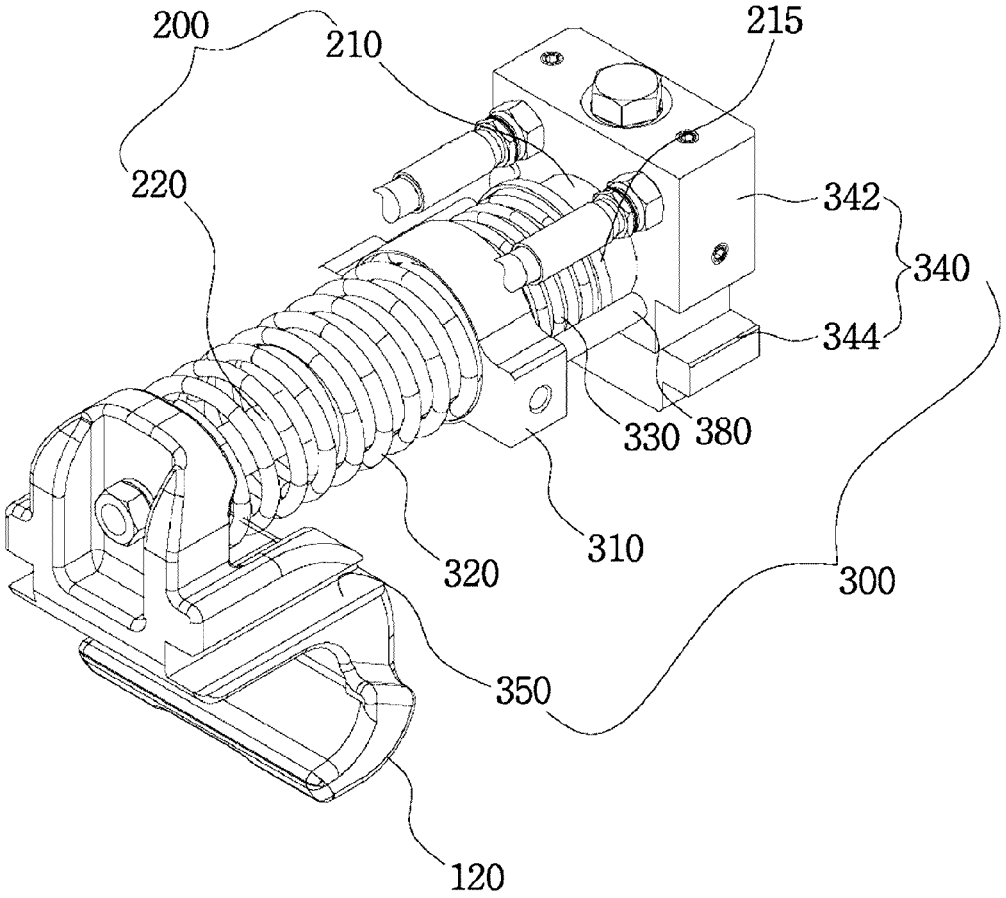
FIG. 3 is a perspective view showing a main portion of the embodiment of the present invention.
Figure 4:
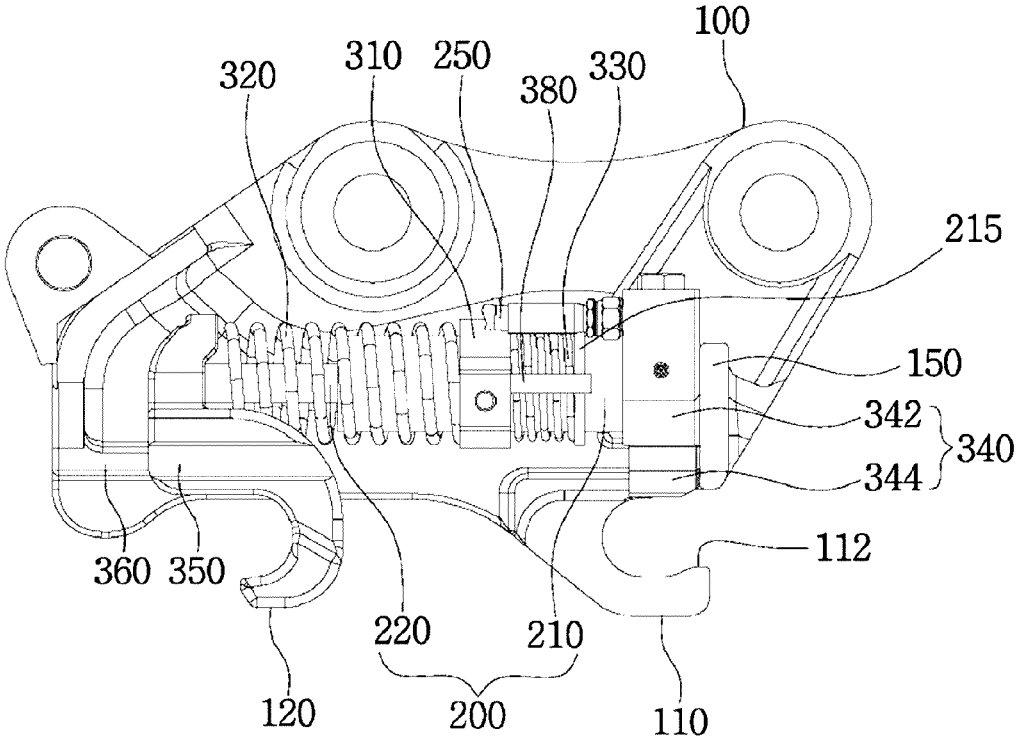
FIG. 4 is a front view showing a locking means and a cylinder according to the present invention.

Referring to FIGS. 3 and 4, the first compression spring 320 has one end portion supported on the hitch 120 and the other end portion supported on the fastening block 310 fixed to the quick coupler body 100 to provide elastic force pushing the hitch 120 outward.

Therefore, the first compression spring 320 is disposed between the hitch 120 and the fastening block 310 to provide elastic force pushing the hitch 120 and the fastening block 310, and thus, although a hydraulic pressure is not transmitted to the cylinder 200 due to oil leakage, the first compression spring 320 performs a safety function of preventing the second attachment pin 22 from being arbitrarily separated from the hitch 120 by pushing the hitch 120 outward so as not to be pushed in a reverse direction.

The second compression spring 330 has one end portion supported on the other side of the fastening block 310 and the other end portion supported on a protruding part 215 fixed to an outer side of the cylinder tube 210 and providing an elastic force to push the cylinder tube 210 toward the body stanchion 150.

In this case, an elastic force E1 of the first compression spring 320 is greater than an elastic force E2 of the second compression spring 330 (E1>E2).

Further, the second compression spring 330 is interposed between the fastening block 310 and the protruding part 215 of the cylinder tube 210, and thus, although a hydraulic pressure is not transmitted to the cylinder 200 due to oil leakage, the second compression spring 330 pushes the cylinder tube 210 and the blocking block 340 toward the body stanchion 150 so that the anti-breakaway plate 344 is positioned above the first attachment pin 21 coupled to the fixed hook 110, thereby performing a safety function of preventing the first attachment pin 21 from being arbitrarily separated.

The fixed hook 110 has a structure in which a locking protuberance 112 protrudes upward from an end portion thereof at an inlet side to which the first attachment pin 21 approaches in a direction in which a width of an inlet is decreased in the drawing.

The locking protuberance 112 has a function of preventing the first attachment pin 21 from being separated in a lateral direction when the first attachment pin 21 is separated through the inlet in a state in which the first attachment pin 21 is coupled in the fixed hook 110.

Further, as shown in FIG. 4, the locking means 300 further includes guide groove portions 350 formed in both outer surfaces of the hitch 120 in a concave groove form to slidably move forward and backward and a guide projection 360 protruding from inner surfaces of the quick coupler body 100 facing each other and inserted into the guide groove portions 350 to slidably move, and the hitch 120 has a structure of slidably moving in a lateral direction according to forward and backward movement of the cylinder rod 220.

The blocking block 340 includes a connection block 342 fixed to one side of the cylinder tube 210, operated in association with the movement of the cylinder tube 210, and connected with the hydraulic hose 250 so that an external hydraulic pressure is transmitted to the inside of the hydraulic hose 250 so as to transmit a hydraulic pressure to the cylinder tube 210 and includes an anti-breakaway plate 344 which is coupled to a lower side of the connection block 342 to be attached or detached by a fastening member, such as a bolt, and is disposed above the first attachment pin 21 when the connection block 342 moves forward so as to prevent the first attachment pin 21 from being separated from the fixed hook 110.

Figure 5A:
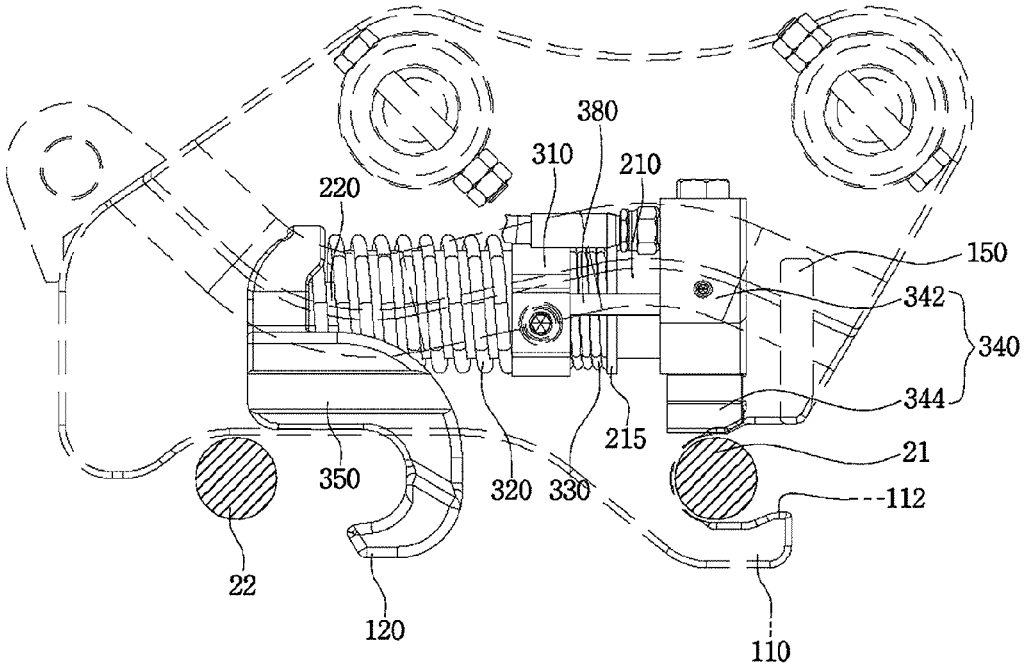
FIGS. 5*a*, 5*b*, and 5*c* are use state views sequentially showing a locking state of a fixed hook according to the present invention.

In the present invention, the quick coupler body 100 is connected to an end portion of an excavator arm (not shown) and a push link, and the fixed hook 110 is coupled to the first attachment pin 21 by operating the excavator arm as shown in FIG. 5*a*.

Figure 5B:
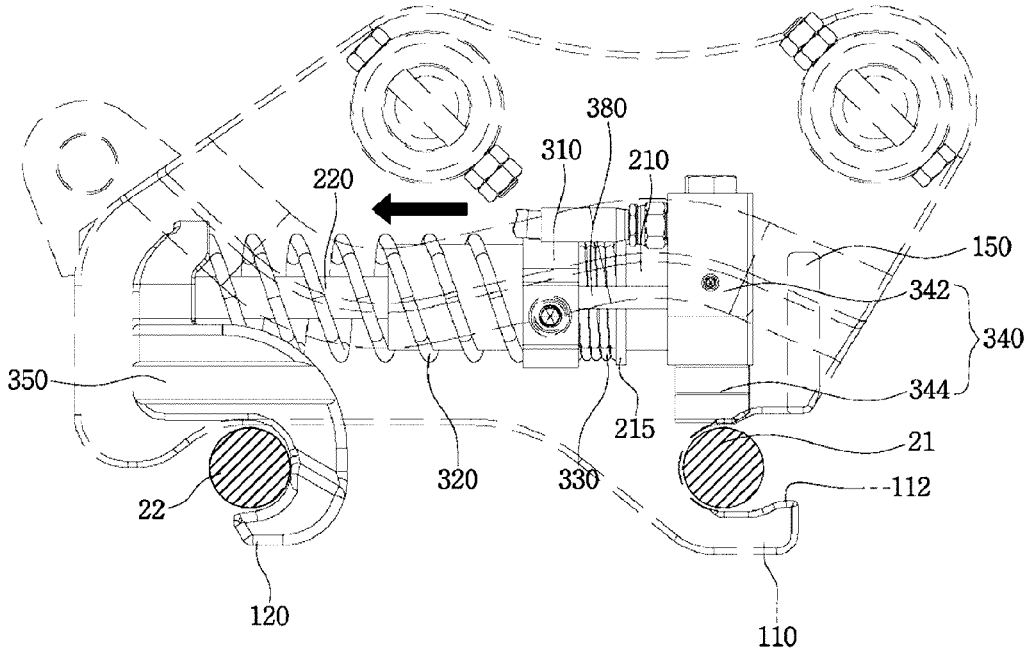

In this case, a hydraulic cylinder is used as the cylinder 200, and when a hydraulic pressure is supplied to the cylinder 200 in one direction in which the cylinder rod 220 moves forward, as shown in FIG. 5*b*, the cylinder rod 220 moves forward to move the hitch 120 toward the second attachment pin 22, and thus the hitch 120 is coupled to the second attachment pin 22.

When the guide projections 360 protruding from both outer sides of the hitch 120 and formed on both inner surfaces of the quick coupler body 100 facing each other slidably move in the guide groove portions 350 formed in both outer sides of the hitch 120, the hitch 120 slides in a lateral direction.

In this case, the blocking block 340 is positioned at a position separated from the body stanchion 150, and thus a state in which the first attachment pin 21 may be separated from the fixed hook 110 is maintained.

Figure 5C:
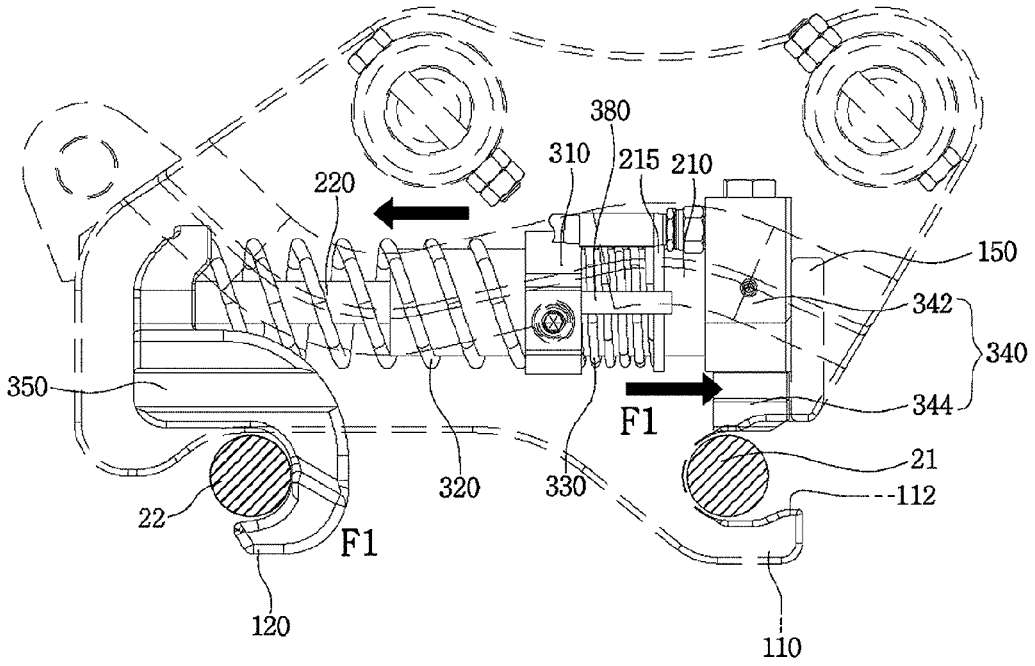

When a hydraulic pressure is continuously transmitted to the cylinder 200 in one direction even when the hitch 120 is coupled to the second attachment pin 22, as shown in FIG. 5C, forward repulsive force F1 is generated in the cylinder rod 220, and the cylinder tube 210 is moved by the forward repulsive force F1 toward the body stanchion 150 (the right side in the drawings), which is a direction opposite to a forward direction of the hitch 120.

In this case, when the cylinder tube 210 is moved by the forward repulsive force F1, an elastic force of the second compression spring 330 supported on the fastening block 310 is applied as force pushing the cylinder tube 210 toward the body stanchion 150 so as to be applied as force assisting to a double movement force of the cylinder tube 210.

When the cylinder tube 210 is moved toward the body stanchion 150, the blocking block 340 coupled to an end portion of the cylinder tube 210 is interworked with the cylinder tube 210, and thus the anti-breakaway plate 344 is positioned above the first attachment pin 21.

Therefore, the anti-breakaway plate 344 is positioned above the first attachment pin 21 when the first attachment pin 21 is coupled to the fixed hook 110 so as to prevent the first attachment pin 21 from being separated from the inlet together with the locking protuberance 112 of the fixed hook 110.

Figure 6A:
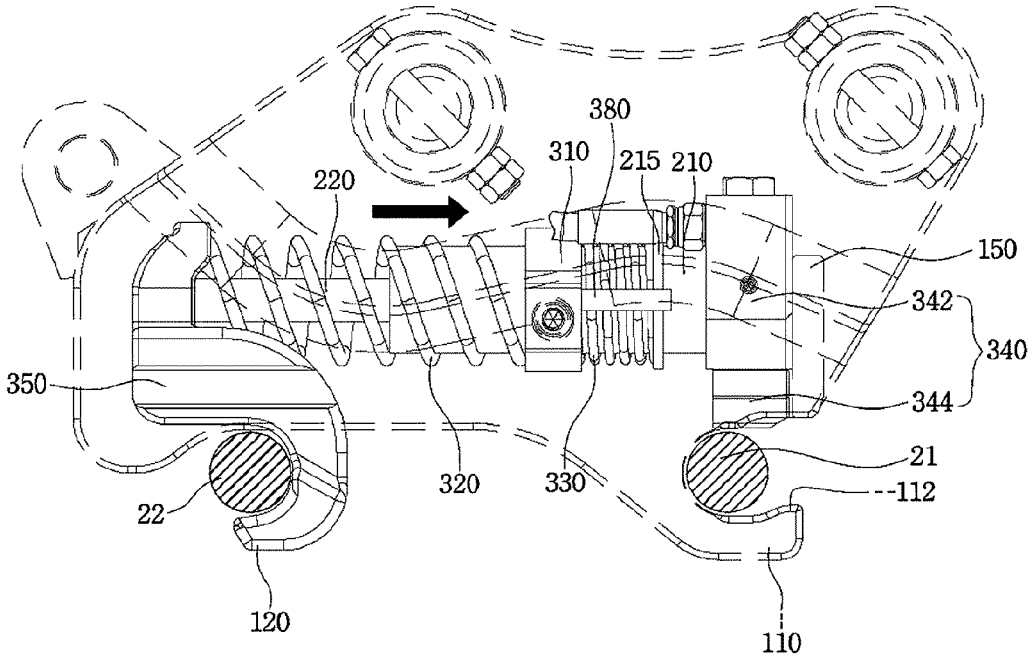
FIGS. 6*a*, 6*b*, and 6*c* are use state views showing a detachment operation of unlocking the locking means according to the present invention.

Meanwhile, when the quick coupler body 100 is detached from attachment equipment, as shown in FIG. 6*a*, the elastic force E1 of the first compression spring 320 is greater than the elastic force E2 of the second compression spring 330

Figure 6B:
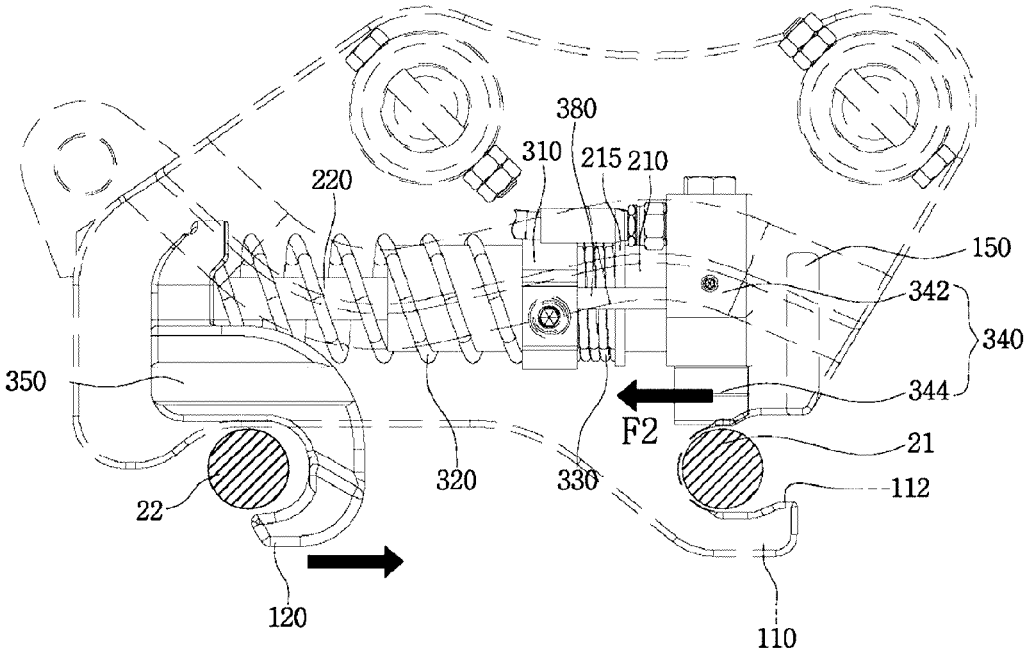

(E1>E2) when a hydraulic pressure is supplied to the cylinder 200 in the other direction in which the hitch 120 moves backward, and thus, as shown in FIG. 6*b*, backward repulsive force F2 for force in which the hitch 120 allows the first compression spring 320 to contract is transmitted to the cylinder tube 210, and the cylinder tube 210 and the blocking block 340 connected to the cylinder tube 210 are moved in a left direction of the drawings (toward the hitch 120).

Figure 6C:
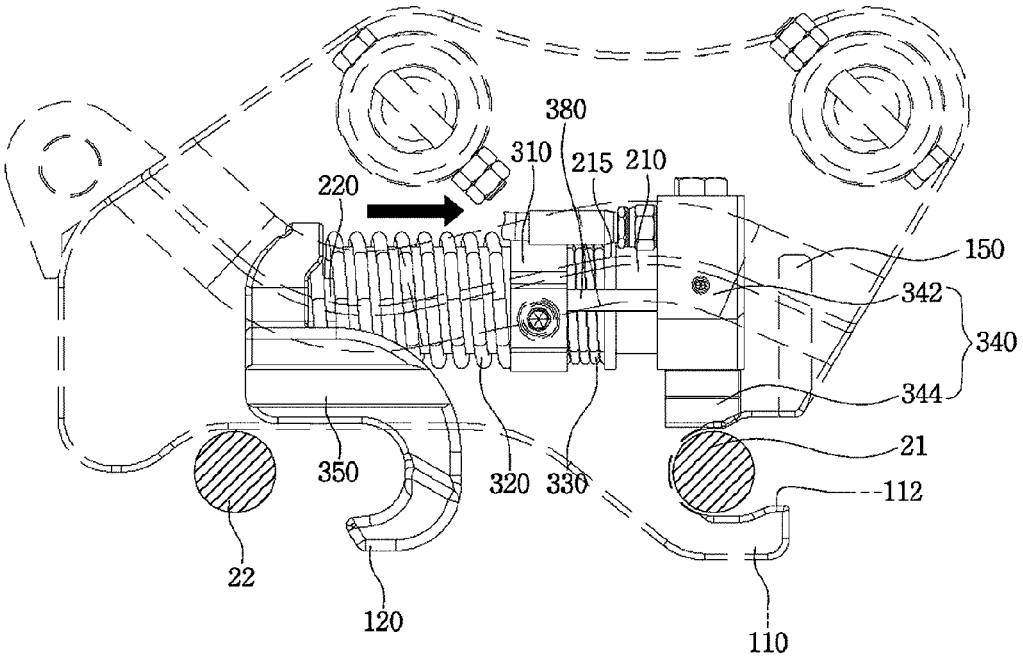

When the blocking block 340 comes into contact with the stopper member 380 to stop, as shown in FIG. 6*c*, the hitch 120 is moved backward by contraction of the cylinder rod 220 so as to release a coupling state with the second attachment pin 22.

Then, the quick coupler body 100 is rotated so that the fixed hook 110 and the first attachment pin 21 are separated from each other.

Therefore, when the cylinder rod 220 moves forward and backward, the hitch 120 slidably moves forward and backward along an inner surface of the quick coupler body 100, and the cylinder tube 210 is moved by forward and backward repulsive force F1 and F2 generated when the hitch 120 moves forward and backward in left and right directions of the cylinder tube 210. The blocking block 340 connected to an end portion of the cylinder tube 210 is interworked with the movement of the cylinder tube 210 and selectively prevents the first attachment pin 21 coupled to the fixed hook 110 from being separated so as to prevent the first attachment pin 21 coupled to the fixed hook 110 from being separated, and thus an accident can be prevented.

Further, since the hitch 120 slidably moves in the quick coupler body 100 due to the operation of the rod 220 of the cylinder 200, the hitch 120 and the second attachment pin 22 can be conveniently coupled to or separated from each other.

Further, even in an emergency situation in which a hydraulic pressure is not transmitted to the cylinder 200 due to oil leakage, the elastic force of the first compression spring 320 pushes the hitch 120 outward to prevent the second attachment pin 22 and the hitch 120 from being separated, and the elastic force of the second compression spring 330 pushes the cylinder tube 210 and the blocking block 340 toward the body stanchion 150 so that the anti-breakaway plate 344 is positioned above the first attachment pin 21. Thus, a separation direction of the first attachment pin 21 is limited to a diagonal direction based on structural properties of the fixed hook 110 having the locking protuberance 112, and the anti-breakaway plate 344 interferes with the first attachment pin 21 to prevent the first attachment pin 21 from being separated.

Meanwhile, in another embodiment of the double safety device for a quick coupler according to the present invention, unlike the previous embodiment, locking means comprises a fastening block being positioned outside a cylinder tube of the cylinder and being fixed on the quick coupler body, a first compression spring being supported at one end by the hitch and the other end by the fastening block to apply an elastic compression force to the hitch, a second compression spring having an elastic compression force to push the cylinder tube toward a body stanchion and having one end supported on the other side of the fastening block and the other end supported on a protruding part protruding outside the cylinder tube, a blocking block being coupled with one side of the cylinder tube, being interlocked when the cylinder tube moves and being positioned on upper side of the fastening block to block a detachment of the fixed hook and the first attachment pin and a stopper member being formed to protrude at one side or the other side of the fastening block, and limiting a backward motion of the hitch.

In this case, an elastic force of the second compression spring is greater than an elastic force of the first compression spring 330.

The fixing process of fixing the quick coupler of the other embodiment to the first and second attachment pins may be performed by after attaching the fixed hook to the first attachment pin, the cylinder tube and the blocking block are moved toward the body stanchion by the elastic force of the second compression spring supported on the fastening block, an anti-breakaway plate is positioned on the upper side of the first attachment pin.

Therefore, the anti-breakaway plate is positioned above the first attachment pin when the first attachment pin is coupled to the fixed hook so as to prevent the first attachment pin from being separated from the inlet together with the locking protuberance of the fixed hook.

Thereafter, when the hydraulic pressure is supplied to the cylinder in one direction (outer direction) for advancing the cylinder rod, the cylinder rod is advanced to move the hitch to the second attachment pin side so that the hitch is coupled to the second attachment pin.

When the guide projections protruding from both outer sides of the hitch and formed on both inner surfaces of the quick coupler body facing each other slidably move in the guide groove portions formed in both outer sides of the hitch, the hitch slides in a lateral direction.

The quick coupler detaching process of another embodiment of the present invention cause the hitch is slidably guided by the guide projection and the guide portions by guiding the backward movement of the cylinder rod and one side of the hitch is contacted with the stopper member formed on one side of the fastening block so that the backward movement of the hitch is restricted.

When a hydraulic pressure for contracting the cylinder rod is transmitted even after the hitch contacts the stopper member and the movement of the cylinder rod is blocked, the stopper repulsive force for moving the cylinder tube in the left direction is generated.

The anti-breakaway plate which is blocking detachment the upper side of the first attachment pin coupled to the fixed hook is moved to a position (the left fastening block) where the first attachment pin is not interfered when the first attachment pin is detached from the fixing hook like the connection block, since the blocking block connected to the cylinder tube moves toward the fastening block while the cylinder tube is moved toward the hitch by the stopper repulsive force.

Then, the quick coupler can be rotated to release the engagement between the fixing hook and the first attachment pin.

Meanwhile, the present invention is not limited by the disclosed embodiments, and it is obvious to those skilled in the art that various changes and modifications may be made without departing from the spirit and scope of the present invention. Therefore, it will be understood that modified examples and changed examples are included in the scope of the embodiments.

The invention claimed is:

1. A double safety device for a quick coupler, the device comprising:

a quick coupler body connected to an arm of an excavator;

a fixed hook provided on one side of the quick coupler body and being coupled with a first attachment pin;

a hitch provided on an other side of the quick coupler body, connected to a cylinder load of a cylinder and coupled with a second attachment pin during forward motion of the cylinder load; and a locking means for preventing disengagement of the fixed hook and the first attachment pin;

wherein the locking means comprises:

a fastening block positioned outside a cylinder tube of the cylinder and fixed on the quick coupler body, a first compression spring provided between the fasting block and the hitch and assigning an elastic compression force, wherein the first compression spring is supported on a first side of the fastening block, a second compression spring having an elastic compression force to push the cylinder tube toward a body stanchion and having one end supported on a second side of the fastening block opposite the first side and the other end supported on the cylinder tube, a blocking block coupled with one side of the cylinder tube, interlocked when the cylinder tube moves and positioned on an upper side of the fastening block to block a detachment of the fixed hook and the first attachment pin, and a stopper member formed to protrude at the first side or the second side of the fastening block, and to limit a backward motion of the hitch or the blocking block by contacting during the backward motion of the hitch or the blocking block.

2. The double safety device for quick coupler according to claim 1, wherein the locking means further comprises:

a guide groove portion formed on both outer sides of the hitch in a groove shape, and a guide projection formed to protrude from inner side surfaces of the quick coupler body facing each other and slid inserted in the guide groove portion 350.

3. The double safety device for quick coupler according to claim 1, wherein an elastic force of the first compression spring is greater than an elastic force of the second compression spring.

4. The double safety device for quick coupler according to claim 1, wherein an elastic force of the second compression spring is greater than an elastic force of the first compression spring.

5. The double safety device for quick coupler according to claim 1, wherein the fixed hook is formed that a locking protuberance protrudes in a direction to reduce width of entry which is entered by the first attachment pin at an end of the entry.

6. The double safety device for quick coupler according to claim 1, wherein the blocking block comprises:

a connection block fixed to one side of the cylinder tube and interlocked with motion of the cylinder tube; and an anti-breakaway plate to prevent the first attachment pin from broken away from the fixed hook, coupled detachably to lower side of the connection block, and positioned on an upper side of the first attachment pin when the connection block moves forward.

* * * * *